US011129439B2

(12) United States Patent
Amos et al.

(10) Patent No.: US 11,129,439 B2
(45) Date of Patent: Sep. 28, 2021

(54) GROUND-ENGAGING STRUCTURES FOR ARTICLES OF FOOTWEAR

(71) Applicant: NIKE, Inc., Beaverton, OR (US)

(72) Inventors: Michael S. Amos, Beaverton, OR (US); Karen S. Dimoff, Portland, OR (US); Lysandre Follet, Portland, OR (US); Thomas Foxen, Portland, OR (US); John Hurd, Lake Oswego, OR (US); Shane S. Kohatsu, Portland, OR (US); Troy C. Lindner, Portland, OR (US); David J. Roulo, Portland, OR (US); Adam Thuss, Portland, OR (US); Andrea Vinet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 172 days.

(21) Appl. No.: 15/575,459

(22) PCT Filed: May 20, 2016

(86) PCT No.: PCT/US2016/033517
§ 371 (c)(1),
(2) Date: Nov. 20, 2017

(87) PCT Pub. No.: WO2016/191275
PCT Pub. Date: Dec. 1, 2016

(65) Prior Publication Data

US 2018/0192738 A1 Jul. 12, 2018

Related U.S. Application Data

(60) Provisional application No. 62/165,584, filed on May 22, 2015.

(51) Int. Cl.
*A43B 5/06* (2006.01)
*A43B 13/12* (2006.01)
(Continued)

(52) U.S. Cl.
CPC ..... *A43B 13/223* (2013.01); *A43B 1/0009* (2013.01); *A43B 5/06* (2013.01);
(Continued)

(58) Field of Classification Search
CPC ..... A43B 5/06; A43B 13/12; A43B 13/122; A43B 13/16; A43C 15/161; A43C 15/165
See application file for complete search history.

(56) References Cited

U.S. PATENT DOCUMENTS 3,328,901 A * 7/1967 Strickland ..... A43C 15/161 36/127
3,383,782 A * 5/1968 McGinnity ..... A43B 3/30 36/3 A
(Continued)

FOREIGN PATENT DOCUMENTS

CN 2590408 Y 12/2003
FR 2320068 A1 3/1977
WO 8808263 A1 11/1988

OTHER PUBLICATIONS

Aug. 12, 2016—International Search Report—PCTUS2016/033517.

*Primary Examiner* — Sharon M Prange
(74) *Attorney, Agent, or Firm* — Banner & Witcoff, Ltd.

(57) ABSTRACT

Ground-engaging components for articles of footwear include: (a) an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component, and wherein a rearmost extent of the outer perimeter boundary rim is located within one of: an arch support area or a forward heel support area of the ground-engaging compo-
(Continued)

nent (and/or at these areas of an overall sole structure); and (b) a support structure extending from the outer perimeter boundary rim and into or at least partially across the open space.

17 Claims, 11 Drawing Sheets

(51) Int. Cl.

| | |
|---|---|
| ***A43C 15/16*** | (2006.01) |
| ***A43B 13/22*** | (2006.01) |
| ***A43B 1/00*** | (2006.01) |
| ***A43B 13/04*** | (2006.01) |
| ***A43B 23/22*** | (2006.01) |
| ***A43B 13/18*** | (2006.01) |
| ***A43C 15/00*** | (2006.01) |

(52) U.S. Cl.
CPC ..... *A43B 13/04* (2013.01); *A43B 13/122* (2013.01); *A43B 13/186* (2013.01); *A43B 23/22* (2013.01); *A43C 15/005* (2013.01); *A43C 15/161* (2013.01); *A43C 15/165* (2013.01)

(56) References Cited

U.S. PATENT DOCUMENTS

| | | | | |
|---|---|---|---|---|
| 3,822,488 | A * | 7/1974 | Johnson | A43B 5/06 36/129 |
| 3,918,181 | A * | 11/1975 | Inohara | A43B 5/00 36/129 |
| 4,085,526 | A * | 4/1978 | Hemmer | A43B 13/26 36/59 R |
| 4,202,116 | A * | 5/1980 | Dassler | A43B 13/26 36/30 R |
| 4,212,120 | A * | 7/1980 | Bowerman | A43B 5/06 36/129 |
| 5,483,760 | A * | 1/1996 | Kataoka | A43B 5/06 36/129 |
| 5,533,282 | A * | 7/1996 | Kataoka | A43B 5/06 36/129 |
| 7,954,258 | B2 * | 6/2011 | Gerber | A43B 5/02 36/59 R |
| 2005/0160630 | A1 | 7/2005 | Perron | |
| 2009/0100716 | A1 | 4/2009 | Gerber | |
| 2009/0172971 | A1 * | 7/2009 | Peikert | A43B 13/026 36/88 |
| 2014/0182170 | A1 | 7/2014 | Wawrousek et al. | |
| 2014/0202042 | A1 | 7/2014 | Berend et al. | |
| 2015/0082669 | A1 | 3/2015 | Peikert et al. | |
| 2015/0181974 | A1 * | 7/2015 | Davis | A43B 5/06 36/91 |

* cited by examiner

GROUND-ENGAGING STRUCTURES FOR ARTICLES OF FOOTWEAR

CROSS-REFERENCE TO RELATED APPLICATION

This application is a U.S. National Stage application under 35 U.S.C. § 371 of International Application PCT/US2016/033517, filed May 20, 2016, which claims priority to U.S. Provisional Patent Application No. 62/165,584, titled "Ground-Engaging Structures for Articles of Footwear" and filed May 22, 2015. These applications, in their entirety, are incorporated by reference herein.

FIELD OF THE INVENTION

The present invention relates to the field of footwear. More specifically, aspects of the present invention pertain to articles of athletic footwear and/or ground-engaging structures for articles of footwear, e.g., used in track and field events and/or relatively long distance running events (e.g., for 3K, 5K, 10K, half marathons, etc.).

TERMINOLOGY/GENERAL INFORMATION

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1 also provides information that may be useful for explaining and understanding the specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight or force applied to it other than potentially the weight/force of the shoe components with which it is engaged). If the forwardmost and/or rearmost locations of a specific footwear component 100 constitute a line segment (rather than a tangent point), then the forwardmost toe location and/or the rearmost heel location constitute the mid-point of the corresponding line segment. If the forwardmost and/or rearmost locations of a specific footwear component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S in an unloaded condition, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

SUMMARY

This Summary is provided to introduce some concepts relating to this invention in a simplified form that are further described below in the Detailed Description. This Summary is not intended to identify key features or essential features of the invention.

While potentially useful for any desired types or styles of shoes, aspects of this invention may be of particular interest for athletic shoes, including track shoes or shoes for relatively long distance runs (e.g., for 3K, 5K, 10K, half marathons, etc.).

Some aspects of this invention relate to ground-engaging components for articles of footwear that include: (a) an outer perimeter boundary rim (e.g., at least 3 mm wide (0.12 inches)) that at least partially defines an outer perimeter of the ground-engaging component (the outer perimeter boundary rim may be present around at least 80% or at least 90% of the outer perimeter of the ground-engaging component), wherein the outer perimeter boundary rim defines an upper-facing surface and a ground-facing surface opposite the upper-facing surface, wherein the outer perimeter boundary rim defines an open space at least at a forefoot support area of the ground-engaging component, and wherein a rearmost extent of the outer perimeter boundary rim is located within one of: an arch support area or a forward heel support area of the ground-engaging component (and/or at these areas of an overall sole structure); and (b) a support structure extending from the outer perimeter boundary rim and into or at least partially across the open space.

In at least some example structures in accordance with aspects of this invention, the support structure will include a matrix structure extending from the outer perimeter boundary rim (e.g., from the ground-facing surface and/or the upper-facing surface) and into or at least partially across the open space at least at the forefoot support area to define an open cellular construction with plural open cells within the open space. This matrix structure further may define one or more partially open cells located within the open space and/or one or more closed cells (e.g., cells located at the ground-facing surface of the outer perimeter boundary rim). In at least some examples of this invention, a plurality of the open cells of the open cellular construction (and optionally at least 50%, at least 60%, at least 70%, at least 80%, at least 90%, or even at least 95%) have openings with curved perimeters and no distinct corners (e.g., round, elliptical, and/or oval shaped openings). The open space and/or matrix structure may extend to all areas of the ground-engaging component inside its outer perimeter boundary rim.

Additionally or alternatively, if desired, the matrix structure may define one or more cleat support areas for engaging or supporting primary traction elements, such as track spikes or other cleat elements (e.g., permanently fixed cleats or track spikes, removable cleats or track spikes, integrally formed cleats or track spikes, etc.). The cleat support area(s) may be located: (a) within the outer perimeter boundary rim (e.g., on its ground-facing surface), (b) at least partially within the outer perimeter boundary rim (e.g., at least partially within its ground-facing surface), (c) within the open space, (d) extending from the outer perimeter boundary rim into and/or across the open space, and/or (e) between a lateral side of the outer perimeter boundary rim and a medial side of the outer perimeter boundary rim. The matrix structure further may define a plurality of secondary traction elements at various locations, e.g., dispersed around one or more of any present cleat support areas; between open and/or partially open cells of the matrix structure; at the outer perimeter boundary rim; at "corners" of the matrix structure; etc.

While the primary traction elements may be provided at any desired locations on ground-engaging components in accordance with this invention, in some example structures the cleat support areas for primary traction elements will be provided at least at two or more of the following: (a) a first cleat support area (and optionally with an associated primary traction element) at or at least partially in a lateral side of the ground-facing surface of the outer perimeter boundary rim; (b) a second cleat support area (and optionally with an associated primary traction element) at or at least partially in the lateral side of the ground-facing surface of the outer perimeter boundary rim and located forward of the first cleat support area; (c) a third cleat support area (and optionally with an associated primary traction element) at or at least partially in a medial side of the ground-facing surface of the outer perimeter boundary rim; (d) a fourth cleat support area (and optionally with an associated primary traction element) at or at least partially in the medial side of the ground-facing surface of the outer perimeter boundary rim and located forward of the third cleat support area; (e) a fifth cleat support area (and optionally with an associated primary traction element) at or at least partially in the lateral side of the ground-facing surface of the outer perimeter boundary rim and located forward of the second cleat support area; and (f) a sixth cleat support area (and optionally with an associated primary traction element) at or at least partially in the medial side of the ground-facing surface of the outer perimeter boundary rim and located forward of the fourth cleat support area. Although some ground-engaging components according to some aspects of this invention will include only these six cleat support areas (and associated primary traction elements), more or fewer cleat support areas (and primary traction elements associated therewith) may be provided, if desired.

The matrix structure in accordance with at least some examples of this invention may include at least one set of open and/or partially open cells, wherein geographical centers of at least three cells of this first set of "at least partially open cells" are "substantially aligned" or "highly substantially aligned" (the term "at least partially open cells" means one or more of partially open cells and/or open cells, which terms will be explained in more detail below). Optionally, the geographic centers of at least three cells of this first set will be "substantially aligned" or "highly substantially aligned" along a line that extends from a rear lateral direction toward a forward medial direction of the ground-engaging component and/or the article of footwear in which it may be contained. Open or partially open cells are considered to be "substantially aligned," as that term is used herein in this context, if the geographical centers (e.g., centers of the cell openings) of the cells in question lie on a straight line and/or within a distance of 10 mm (0.39 inches) from a straight line. "Highly substantially aligned" cells have their geographic centers (e.g., centers of the openings) lying on a straight line and/or within a distance of 5 mm (0.2 inches) from a straight line. Matrix structures in accordance with at least some examples of this invention may include two or more sets of open and/or partially open cells, wherein geographical centers (e.g., centers of the openings) of at least three cells within the respective sets are substantially aligned or highly substantially aligned with a straight line for that set (and optionally substantially aligned or highly substantially aligned with a straight line that extends from the rear lateral direction toward the forward medial direction of the ground-engaging component and/or sole structure). Some matrix structures in accordance with this invention may include from 2 to 16 sets of substantially aligned cells and/or highly substantially aligned cells, or even from 3-12 (e.g., 10) sets of substantially aligned cells and/or highly substantially aligned cells. When multiple sets of substantially aligned cells and/or highly substantially aligned cells are present in a matrix structure, the aligned or highly aligned sets of cells may be separated from one another along the longitudinal direction of the ground-engaging component and/or sole structure.

Additional aspects of this invention relate to articles of footwear that include an upper and a sole structure engaged with the upper. The sole structure will include a ground-engaging component having any one or more of the features described above and/or any combinations of features described above. The upper may be made from any desired upper materials and/or upper constructions, including upper materials and/or upper constructions as are conventionally known and used in the footwear art (e.g., especially upper materials and/or constructions used in track shoes or shoes for relatively long distance runs (e.g., for 3K, 5K, 10K, half marathons, etc.)). As some more specific examples, at least a portion (or even a majority, all, or substantially all) of the upper may include a woven textile component and/or a knitted textile component (and/or other lightweight constructions).

Articles of footwear in accordance with at least some examples of this invention further may include a midsole component between the ground-engaging component and a bottom of the upper. The midsole component may include any desired materials and/or structures, including materials and/or structures as are conventionally known and used in the footwear art (e.g., especially midsole materials and/or structures used in track shoes or shoes for relatively long distance runs (e.g., for 3K, 5K, 10K, half marathons, etc.)). As some more specific examples, the midsole component may include one or more of: one or more foam midsole elements (e.g., made from polyurethane foam, ethylvinylacetate foam, etc.), one or more fluid-filled bladders, one or more mechanical shock absorbing structures, etc.

If desired, in accordance with at least some examples of this invention, at least some portion(s) of a bottom surface of the midsole component and/or the upper may be exposed and/or visible at an exterior of the sole structure. As some more specific examples, the bottom surface of the midsole component and/or the upper may be exposed/visible: (a) in the open space of the ground-engaging component (e.g., at least in the forefoot support area through open cells and/or partially open cells in any present matrix structure, etc.); (b) in the arch support area of the sole structure (e.g., outside of the outer perimeter boundary rim, through open cells and/or partially open cells in any present matrix structure, etc.); and/or (c) in the heel support area of the sole structure. In some footwear and/or sole structures in accordance with this invention, the outer perimeter boundary rim of the ground-engaging component may taper inward at an arch support area of the sole structure, and the midsole component then can form an outer lateral edge and/or an outer medial edge of the sole structure within at least some of the arch support area of the sole structure. Also, in some examples, the outer perimeter boundary rim of the ground-engaging component may form an outer lateral edge and an outer medial edge of the sole structure in a forefoot support area of the sole structure and the midsole component may form the outer lateral edge and the outer medial edge of the sole structure through at least some of an arch support area of the sole structure.

Also, if desired, sole structures in accordance with at least some examples of this invention further may include a heel reinforcement component, e.g., located at least at a lateral, rear heel support area of the sole structure (e.g., at least at a location of a "heel strike" location during at least some steps cycles for some people). This heel reinforcement component may be located just at the lateral, rear heel support area of the sole structure or at least at a lateral heel support area and a rear heel support area of the sole structure. If desired, the heel reinforcement component also may be formed as a matrix structure with a plurality of open cells and/or partially open cells and/or the heel reinforcement component may be formed to include ground-engaging traction elements (e.g., at various locations in the heel reinforcement component matrix structure around cells of this matrix structure). If desired, when the heel reinforcement component includes a matrix structure, the bottom surface of the midsole component may be exposed and/or visible through the cells of that matrix structure as well.

Additional aspects of this invention relate to methods of making ground-engaging support components, sole structures, and/or articles of footwear of the various types and structures described above.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

Figure 1:
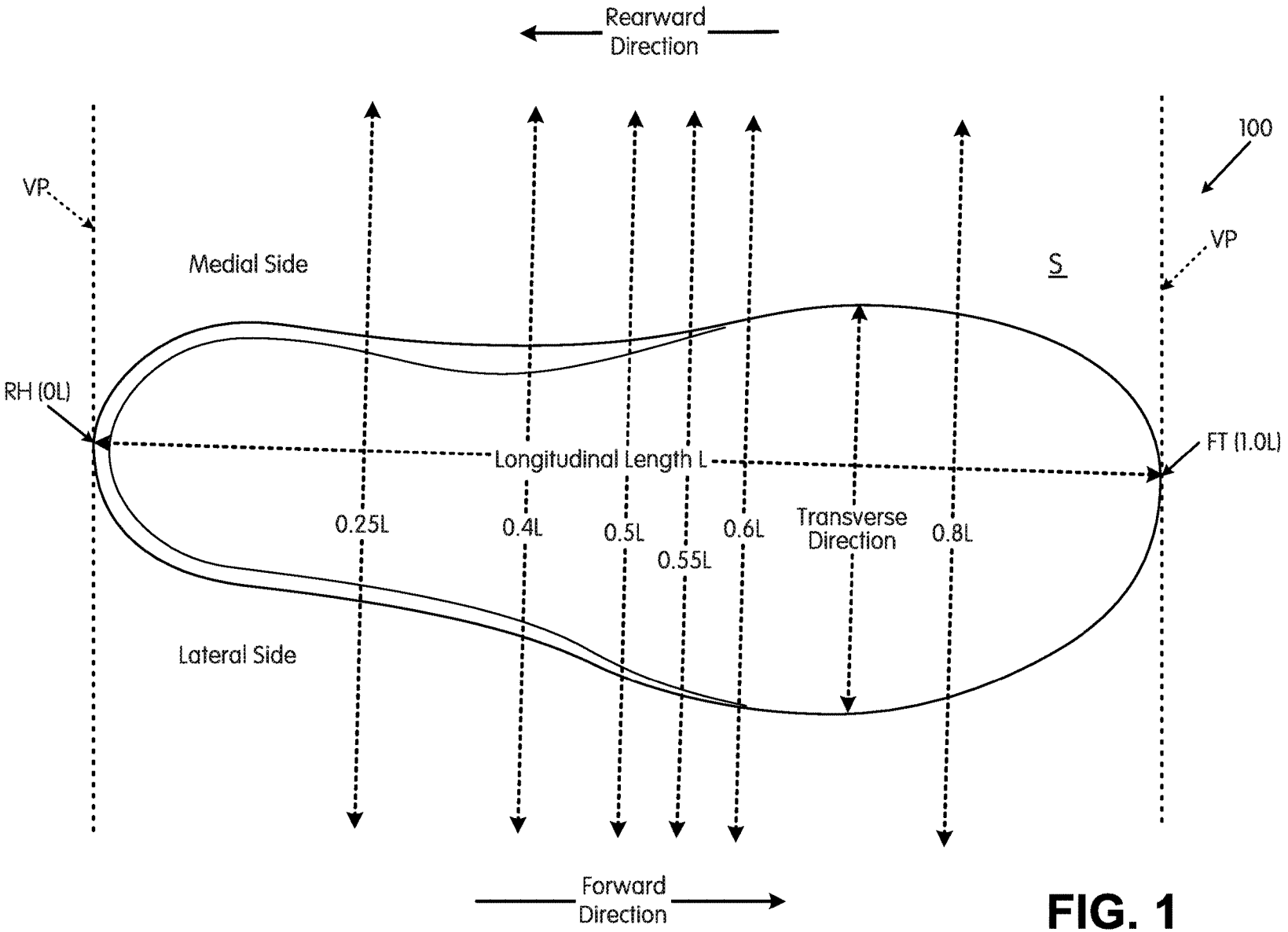
FIG. 1 is provided to help illustrate and explain background and definitional information useful for understanding certain terminology and aspects of this invention.
Figure 2A:
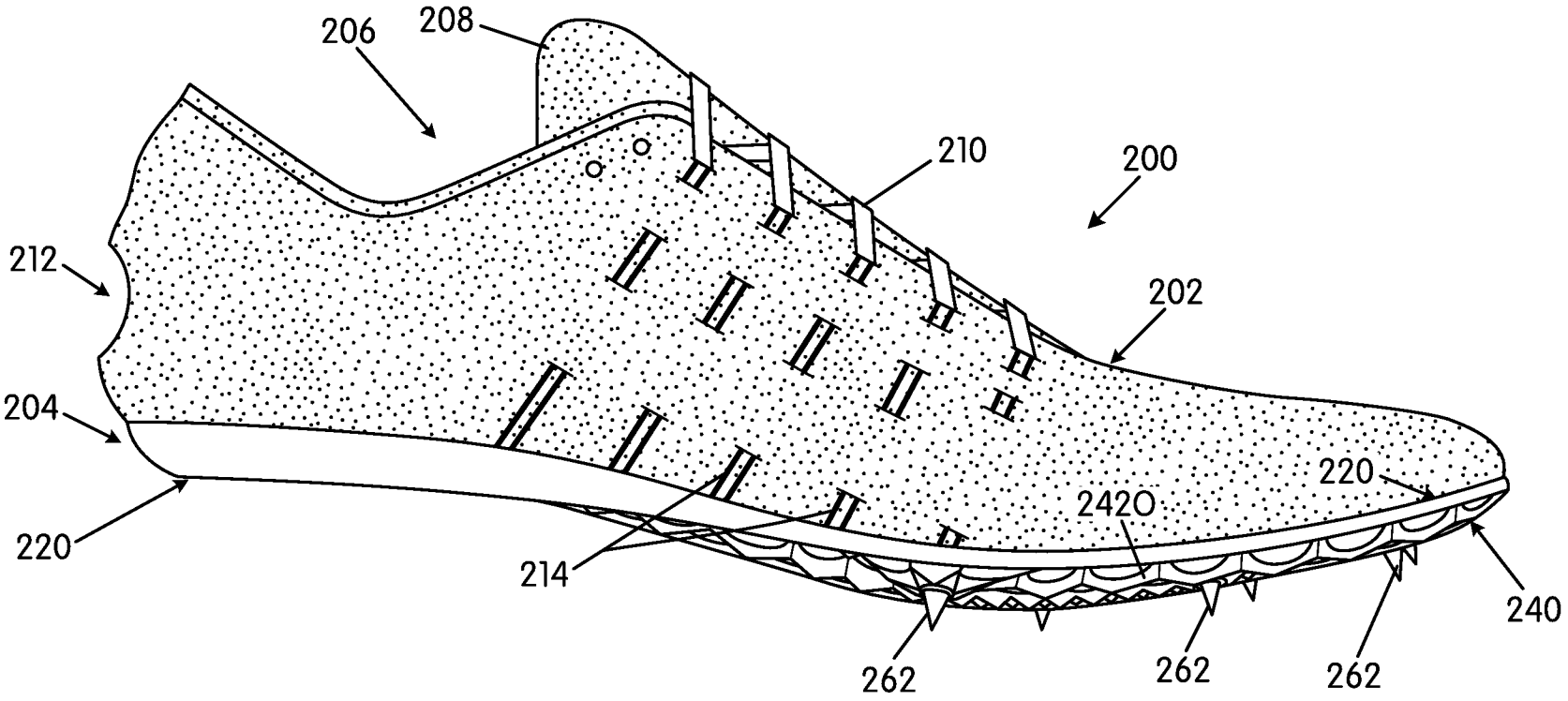
FIGS. 2A-2D provide a lateral side view, a bottom view, an enlarged bottom view around a cleat mount area, and an enlarged perspective view around a cleat mount area, respectively, of an article of footwear in accordance with at least some aspects of this invention.
Figure 2B:
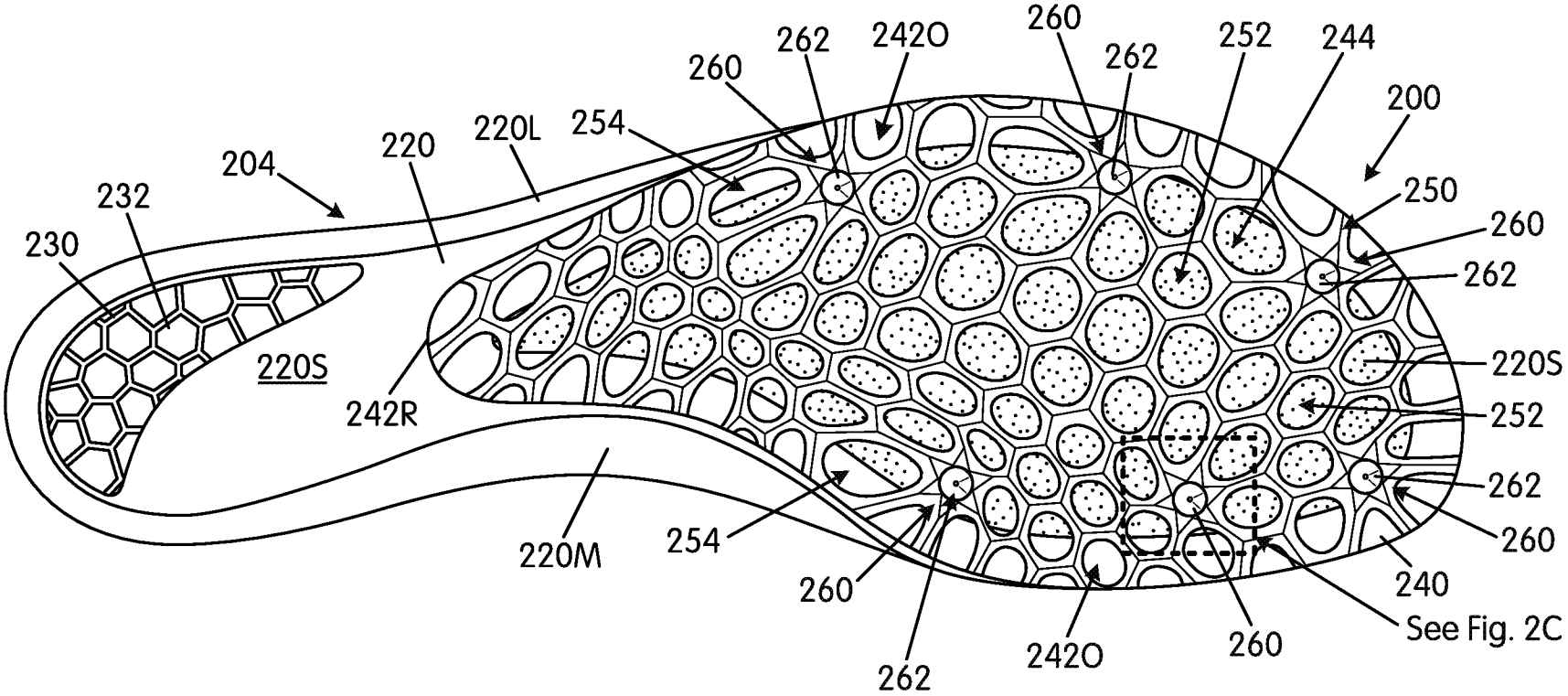
Figure 2D:
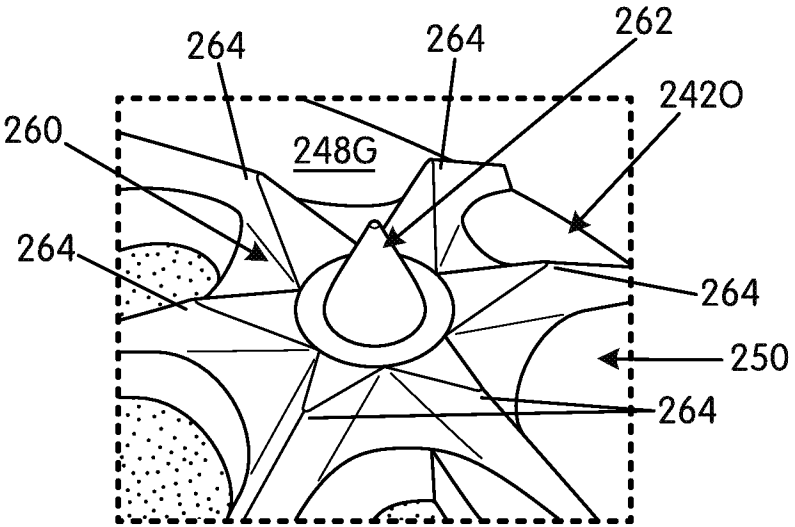

FIGS. 2A and 2B provide lateral side and bottom views, respectively, of an article of footwear 200 in accordance with at least some aspects of this invention. This example article of footwear 200 is a track shoe, and more specifically, a track shoe targeted for relatively long distance runs, such as 3K's, 5K's, 10K's, half marathons, etc. Aspects of this invention, however, also may be used in shoes for other distance runs and/or other types of uses or athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further includes a tongue member 208 located across the foot instep area and positioned so as to moderate the feel of the closure system 210 (which in this illustrated example constitutes a lace type closure system). In this illustrated example, the rear heel area of the upper 202 includes an opening 212 defined therethrough, and a rear heel area of the wearer's foot may be visible and/or exposed through this opening 212.

As mentioned above, the upper 202 may be made from any desired materials and/or in any desired constructions and/or manners without departing from this invention. As some more specific examples, at least a portion of the upper 202 (and optionally a majority, all, or substantially all of the upper 202) may be formed as a woven textile component and/or a knitted textile component. The textile components for upper 202 may have structures and/or constructions like those provided in FLYKNIT® brand footwear and/or via FLYWEAVE™ technology available in products from NIKE, Inc. of Beaverton, Oreg.

Additionally or alternatively, if desired, the upper 202 construction may include uppers having foot securing and engaging structures 214 (e.g., "dynamic" and/or "adaptive fit" structures), e.g., of the types described in U.S. Patent Appln. Publn. No. 2013/0104423, which publication is entirely incorporated herein by reference. More specifically, as shown in FIG. 2A, the lace 210 loops through one or more textile, fiber, filament, or wire type structures 214 (e.g., substantially unstretchable components) located on each side of the instep opening (only the lateral side is shown in FIG. 2A). The components 214 may themselves and/or may engage other components that partially or completely wrap around the wearer's foot (e.g., extending between at least some portion of the sole structure 204 and the upper 202, between layers of the upper 202, and/or beneath a plantar surface of a wearer's foot) so that when the lace 210 is tightened, the components 214 tighten and at least partially wrap around the wearer's foot and securely hold to it. As some additional examples, if desired, uppers and articles of footwear in accordance with this invention may include foot securing and engaging structures of the types used in FLYWIRE® Brand footwear available from NIKE, Inc. of Beaverton, Oreg. Additionally or alternatively, if desired, uppers and articles of footwear in accordance with this invention may include fused layers of upper materials, e.g., uppers of the types included in NIKE's "FUSE" line of footwear products. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

The sole structure 204 of this example article of footwear 200 now will be described in more detail. As shown in FIGS. 2A and 2B, the sole structure 204 of this example includes three main components: a midsole component 220; a heel reinforcement component 230 located at least at a lateral, rear heel support area of the sole structure 204 (optionally engaged with a bottom surface 220S of the midsole component 220 via adhesives or cements, mechanical fasteners, etc.); and a ground-engaging component 240 located at least at a forefoot support area of the sole structure 204 (and optionally engaged with the bottom surface 220S of the midsole component via adhesives or cements, mechanical fasteners, sewing or stitching, etc.). The ground-engaging component 240 of this example has its rearmost extent 242R located within one of: an arch support area or a forward heel support area of the ground-engaging component 240. The midsole component 220 may be located between: (a) a bottom surface of the upper 202 (e.g., a strobel member or other bottom upper component) and the heel reinforcement component 230 and/or (b) a bottom surface of the upper 202 (e.g., a strobel member or other bottom upper component) and the ground-engaging component 240. The midsole component 220 also may form a portion of the ground-contacting surface of the sole structure 204 (e.g., in the heel area and/or midfoot area). These sole structure 204 components will be described in more detail below.

One main foot support component of this example sole structure 204 is the midsole component 220, which in this illustrated example extends to support an entire plantar surface of the wearer's foot (e.g., from the forward-most toe location FT to the rearmost heel location RH and from the lateral side edge to the medial side edge along the entire longitudinal length of the sole structure 204). This midsole component 220, which may be made from one or more parts, may be constructed from a polymeric foam material, such as a polyurethane foam or an ethylvinylacetate ("EVA") foam as are known and used in the footwear arts. Additionally or alternatively, if desired, at least some portion of the midsole component 220 may constitute a fluid-filled bladder, e.g., of the types conventionally known and used in the footwear arts (e.g., available in NIKE "AIR" Brand products), and/or one or more mechanical shock-absorbing components.

In this illustrated example, a bottom surface 220S of the midsole component 220 is visible/exposed at an exterior of the sole structure 204 substantially throughout the bottom of the sole structure 204 (and at least over more than 50% and even more than 75% of the bottom surface area of the sole structure 204). As shown in FIG. 2B, the bottom surface 220S of the midsole component 220 is exposed at the forefoot support area and/or arch support area (through open cells 252 and/or partially open cells 254 of the ground-engaging component 240 (also called the "open space" herein) described in more detail below); in the arch support area outside of the ground-engaging component 240; and in the heel area (at least at the medial side of the heel area, and optionally through a matrix structure provided as part of the rear heel reinforcement component 230). The bottom surface 220S of the midsole component 220 may include texturing or other traction-enhancing features, as well as wear pads and/or other types of reinforcement (e.g., in the higher wear or stress areas). In this illustrated example, the bottom surface 220S of the midsole component 220 has a relatively smooth surface, although any desired design or features could be provided.

As further shown in FIG. 2B, the bottom surface 220S of the midsole component 220 may include a recessed area in which the heel reinforcement component 230 is mounted. The heel reinforcement component 230 may have a matrix type structure with a plurality of open and/or partially open cells 232 (e.g., a honeycomb-like structure). The heel reinforcement component 230 may be constructed from a sturdier, more wear resistant material than the midsole component 220, such as a PEBAX® plastic material (available from Arkema France Corporation), a thermoplastic polyurethane material, a carbon fiber reinforced plastic material, a glass fiber reinforced plastic material, or the like.

This heel reinforcement component 230 provides additional support and/or wear resistance during the foot-strike phase of a typical running/jogging step cycle (at least for some runners). More specifically, many runners tend to land a running or jogging step on the rear, lateral heel area of the foot. As the step continues, the runner's weight force on the foot tends to roll forward and toward the medial side of the foot for the "push off" or "toe-off" phase of the step cycle. Thus, the lateral heel area of a sole structure 204 may be subjected to substantial force and wear when running, and this heel reinforcement component 230 helps provide support and wear resistance at least at this lateral, rear heel support area of the sole structure 204. If desired, as shown in the example of FIG. 2B, the heel reinforcement component 230 may be located at the lateral, rear heel support area of the sole structure 204 and around the rear heel area but terminate closer to the rearmost heel RH location on the medial heel side of the sole structure 204 as compared to on the lateral heel side. Alternatively, if desired, the heel reinforcement component 230 (or another heel reinforcement component) may extend to (or be provided to) protect or support other portions and/or proportions of the medial side and/or the lateral side of the heel support area. As one more specific example, if desired (and as shown in FIG. 4C), the heel reinforcement component 230 may extend such that its matrix structure extends rearward from the rear extent 242R of the ground-engaging component 240 to support and reinforce all or substantially all of the heel support area of the sole structure 204.

While not shown in FIGS. 2A and 2B, if desired, the heel reinforcement component 230 may include ground-engaging traction elements, such as short, sharp points (e.g., less than 3 mm (0.12 inches) tall) that extend from the matrix structure of the heel reinforcement component 230. As a more specific example, if desired, the sharp point traction elements may be provided at the corners of the matrix structure of the heel reinforcement component 230 around the cells 232 (although they could be provided at other locations, if desired). The sharp point traction elements may be integrally formed as part of the heel reinforcement component 230, e.g., by molding them into the heel reinforcement component 230 when the part is made.

Example ground-engaging components 240 for sole structures 204/articles of footwear 200 in accordance with examples of this invention now will be described in more detail with reference to FIGS. 2A through 2D, as well as with reference to FIGS. 3A and 3B. As shown, these example ground-engaging components 240 include an outer perimeter boundary rim 242O, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" $W_O$ is defined as the direct, shortest distance from one edge (e.g., an exterior edge) of the outer perimeter boundary rim 242O to its opposite edge (e.g., an interior edge) by the open space 244, as shown in FIG. 3A. While FIGS. 2B, 3A, and 3B show this outer perimeter boundary rim 242O extending completely and continuously around and defining 100% of an outer perimeter of the ground-engaging components 240, other options are possible. For example, if desired, there may be one or more breaks in the outer perimeter boundary rim 242O at the outer perimeter of the ground-engaging component 240 such that the outer perimeter boundary rim 242O is present around only at least 75%, at least 80%, at least 90%, or even at least 95% of the outer perimeter of the ground-engaging component 240. The outer perimeter boundary rim 242O may have a constant or changing width $W_O$ over the course of the outer perimeter of the ground-engaging component 240. The outer perimeter boundary rim 242O also may extend to define the outer edge of at least a portion of the sole structure 204 (e.g., in the forefoot and/or midfoot support areas, etc.), as shown in FIG. 2B.

FIGS. 2B-3B further show that the outer perimeter boundary rim 242O of this example ground-engaging component 240 defines an open space 244 at least at a forefoot support area of the ground-engaging component 240, and in these illustrated examples, the open space 244 extends into the arch support area of the ground-engaging component 240. The rearmost extent 242R of the outer perimeter boundary rim 242O of these examples is located within an arch support area or a forward heel support area of the ground-engaging component 240. The ground-engaging component 240 may fit and be fixed into a recess formed in the bottom surface 220S and/or side surface of the midsole component 220 (e.g., a recess molded into the midsole component 220 when it is formed), e.g., by cements or adhesives, mechanical fasteners, etc.

The ground-engaging components 240 of these examples are shaped so as to extend completely across the forefoot support area of the sole structure 204 from the lateral side to the medial side. In this manner, the outer perimeter boundary rim 242O forms the medial and lateral side edges of the sole structure 204 at least at the forefoot medial and lateral sides. The outer perimeter boundary rim 242O also forms the forward toe edge of the sole structure 204 around the front toe area.

As one moves rearward in the sole structure 204, however, the outer perimeter boundary rim 242O tapers inward (e.g., in a curved manner) with respect to the overall width of the sole structure 204, e.g., at least at an arch support area of the sole structure 204 (and optionally beginning at the forefoot support area, as shown in the example of FIG. 2B). Therefore, as shown in FIG. 2B, the midsole component 220 forms an outer lateral edge 220L and/or an outer medial edge 220M of the sole structure 204 within at least some of the arch support area of the sole structure 204. While the inwardly tapered (e.g., inwardly curved) end of the ground-engaging component 240 may have any desired shape, in this illustrated example, the rear end of the ground-engaging component 240 tapers inwardly and defines a smoothly curved rear end area at which the rearmost extent 242R is located. As illustrated by FIGS. 2B-3B, the overall ground-contacting component 240 may have somewhat of an overall "teardrop" type shape.

The outer perimeter boundary rim 242O of this illustrated example ground-engaging component 240 defines an upper-facing surface 248U (e.g., as shown in FIG. 3A) and a ground-facing surface 248G (e.g., as shown in FIGS. 2B and 3B) opposite the upper-facing surface 248U. The upper-facing surface 248U provides a surface (e.g., smooth and/or contoured surface) for supporting the wearer's foot and/or engaging the midsole component 220 (and/or optionally engaging the upper 202, if no exterior midsole is present at some or all locations of the sole structure 204). The outer perimeter boundary rim 242O may provide a relatively large surface area for securely supporting a plantar surface of a wearer's foot. Further, the outer perimeter boundary rim 242O may provide a relatively large surface area for securely engaging another footwear component (such as the bottom surface 220S of the midsole component 220 and/or a bottom surface of the upper 202), e.g., a surface for bonding via adhesives or cements, for supporting stitches or sewn seams, for supporting mechanical fasteners, etc.

FIGS. 2B through 3B further illustrate that the ground-engaging component 240 of this example sole structure 204 includes a support structure 250 that extends from the outer perimeter boundary rim 242O into and at least partially across (and optionally completely across) the open space 244. The top surface of this example support structure 250 at locations within the open space 244 lies flush with and/or smoothly transitions into the outer perimeter boundary rim 242O to provide a portion of the upper-facing surface 248U (and may be used for the purposes of the upper-facing surface 248U as described above).

The support structure 250 of these examples extends from the ground-facing surface 248G of the outer perimeter boundary rim 242O to define a portion of the ground-facing surface 248G of the ground-engaging component 240. In the illustrated examples of FIGS. 2A-3B, the support structure 250 includes a matrix structure (also labeled 250 herein) extending from the ground-facing surface 248G of the outer perimeter boundary rim 242O and into, partially across, or fully across the open space 244 to define a cellular construction. The illustrated matrix structure 250 defines at least one of: (a) one or more open cells located within the open space 244, (b) one or more partially open cells located within the open space 244, and/or (c) one or more closed cells, e.g., beneath the outer perimeter boundary rim 242O. An "open cell" constitutes a cell in which the perimeter of the cell opening is defined completely by the matrix structure 250 (note, for example, cells 252 in FIGS. 2B and 3B). A "partially open cell" constitutes a cell in which one or more portions of the perimeter of the cell opening are defined by the matrix structure 250 and one or more other portions of the perimeter of the cell opening are defined by another structure, such as the outer perimeter boundary rim 242O (note, for example, cells 254 in FIGS. 2B and 3B). A "closed cell" may have the outer matrix structure 250 but no opening (e.g., it may be formed such that the portion that would constitute the cell opening is located under the outer perimeter boundary rim 242O). As shown in FIGS. 2B-3B, in the illustrated example matrix structures 250, at least 50% of the open cells 252 and/or partially open cells 254 of the open cellular construction (and optionally, at least 60%, at least 70%, at least 80%, at least 90%, or even at least 95%) have openings with curved perimeters and no distinct corners (e.g., round, elliptical, and/or oval shaped as viewed at least from the upper-facing surface 248U). The open space 244 and/or matrix structure 250 may extend to all areas of the ground-engaging component 240 within the outer perimeter boundary rim 242O.

Figure 2C:
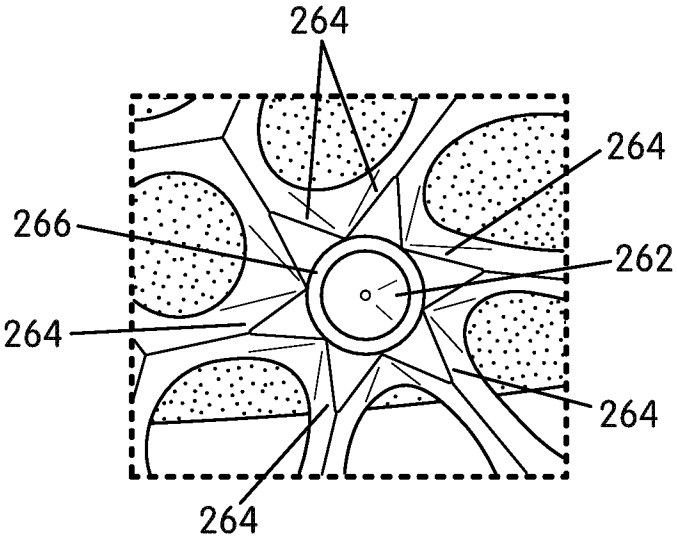
Figure 3A:
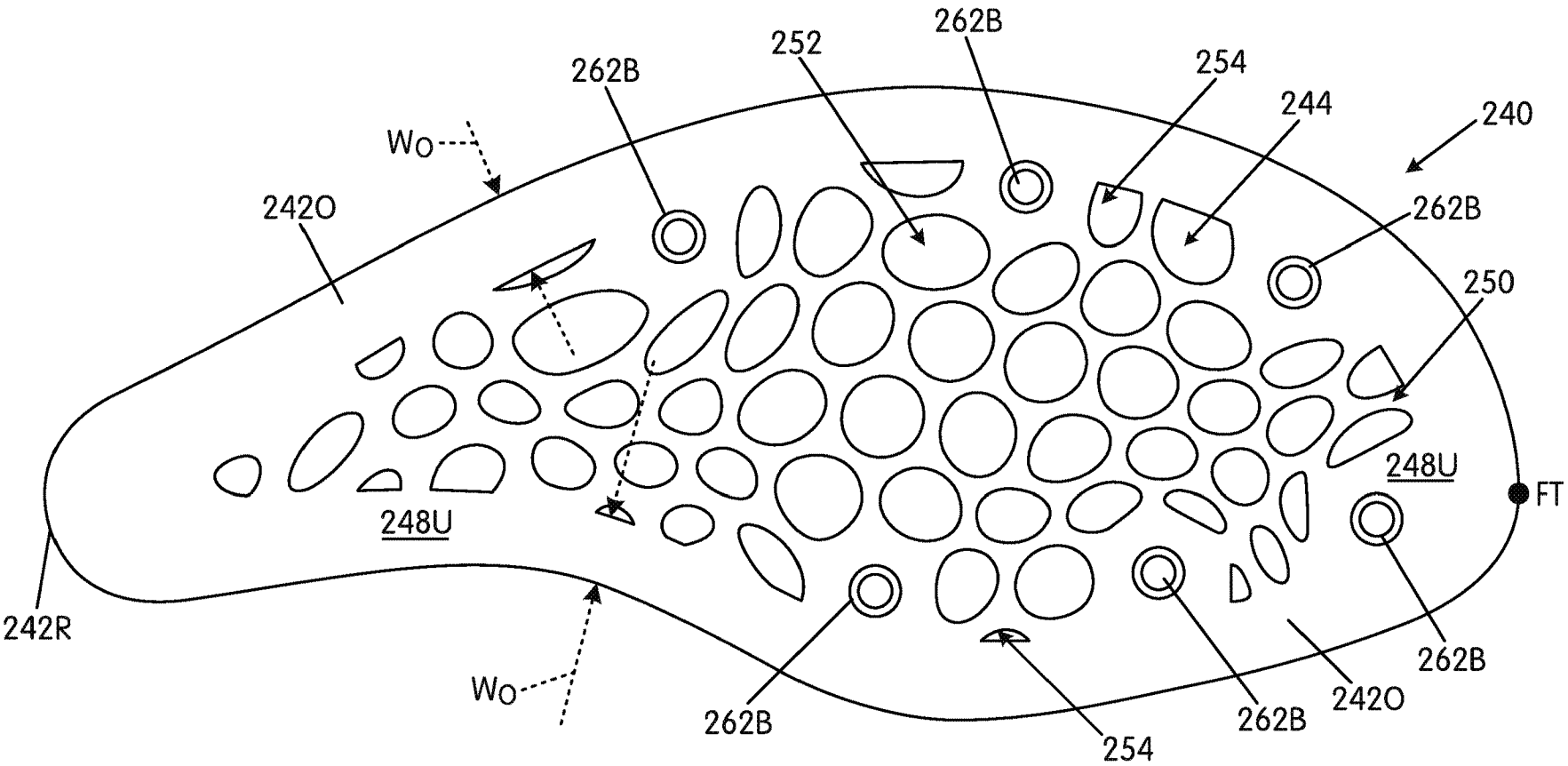
FIGS. 3A and 3B provide a top view and a bottom view, respectively, of a ground-engaging component in accordance with at least some aspects of this invention.
Figure 3B:
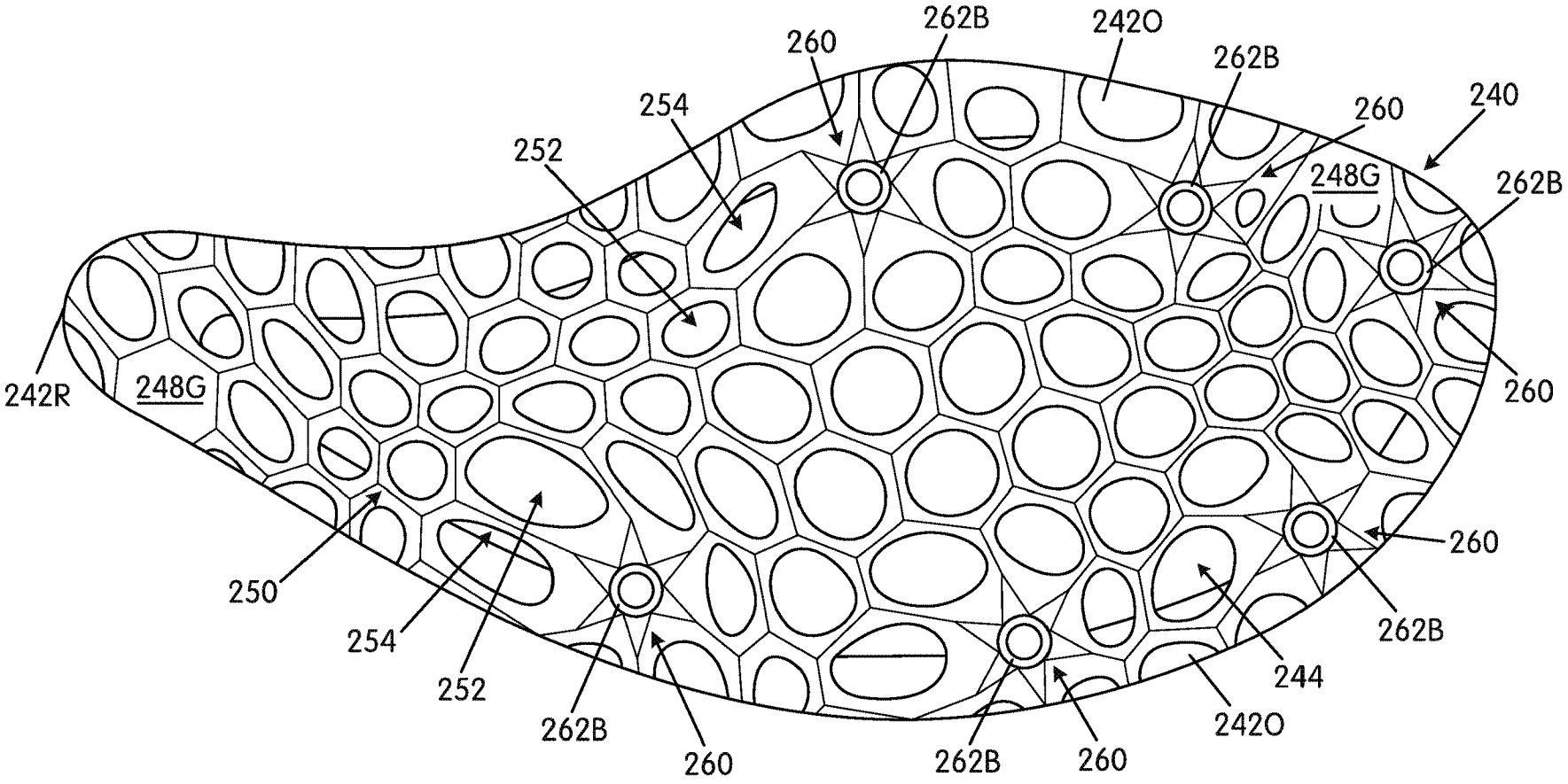

As further shown in FIGS. 2B, 2C, and 3B, the matrix structure 250 further defines one or more primary traction element or cleat support areas 260. Six separate cleat support areas 260 are shown in the examples of FIGS. 2A-3B, with: (a) three primary cleat support areas 260 on the lateral side of the ground-engaging component 240 (one at or near a lateral forefoot support area or a lateral midfoot support area of the ground-engaging component 240, one forward of that one in the lateral forefoot support area, and one forward of that one at the lateral toe support area) and (b) three primary cleat support areas 260 on the medial side of the ground-engaging component 240 (one at or near a medial forefoot support area or a medial midfoot support area of the ground-engaging component 240, one forward of that one in the medial forefoot support area, and one forward of that one at the medial toe support area). Primary traction elements, such as track spikes 262 or other cleats, may be engaged or integrally formed with the ground-engaging component 240 at the cleat support areas 260 (e.g., with one cleat or track spike 262 provided per cleat support area 260). The cleats or track spikes 262 (also called "primary traction elements" herein) may be permanently fixed in their associated cleat support areas 260, such as by in-molding the cleats or track spikes 262 into the cleat support areas 260 when the matrix structure 250 is formed (e.g., by molding). In such structures, the cleat or track spike 262 may include a disk or outer perimeter member that is embedded in the material of the cleat support area 260 during the molding process. As another alternative, the cleats or track spikes 262 may be removably mounted to the ground-engaging component 240, e.g., by a threaded type connector, a turnbuckle type connector, or other removable cleat/spike structures as are known and used in the footwear arts. Hardware or other structures 262B for mounting the removable cleats may be integrally formed in the mount area 260 or otherwise engaged in the mount area (e.g., by in-molding, adhesives, or mechanical connectors). FIGS. 3A and 3B show structures 262B at which a track spike 262 can be removably engaged, e.g., by a threaded connection.

The cleat support areas 260 can take on various structures without departing from this invention. In the illustrated example, the cleat support areas 260 are defined by and as part of the matrix structure 250 as a thicker portion of matrix material located within or partially within the outer perimeter boundary rim 242O and/or located within the open space 244. As various options, if desired, one or more of the cleat support areas 260 may be defined in one or more of the following areas: (a) solely in the outer perimeter boundary rim 242O, (b) partially in the outer perimeter boundary rim 242O and partially in the open space 244, and/or (c) completely within the open space 244 (and optionally located at or adjacent the outer perimeter boundary rim 242O). When multiple cleat support areas 260 are present in a single ground-engaging component 240, all of the cleat support areas 260 need not have the same size, construction, and/or orientation with respect to the outer perimeter boundary rim 242O and/or open space 244 (although they all may have the same size, construction, and/or orientation, if desired).

While other constructions are possible, in this illustrated example (e.g., see FIGS. 2B-2D), the cleat support areas 260 are formed as generally hexagonal shaped areas of thicker material into which or at which at least a portion of the cleat/spike 262 and/or mounting hardware 262B will be fixed or otherwise engaged. The cleat support areas 260 are integrally formed as part of the matrix structure 250 in this illustrated example. The illustrated example further shows that the matrix structure 250 defines a plurality of secondary traction elements 264 dispersed around the cleat support areas 260. While other options and numbers of secondary traction elements 264 are possible, in this illustrated example, a secondary traction element 264 is provided at each of the six corners of the generally hexagonal structure making up the cleat support area 260 (such that each cleat support area 260 has six secondary traction elements 264 dispersed around it). The secondary traction elements 264 of this example are raised, sharp points or pyramid type structures made of the matrix 250 material and raised above a base surface 266 of the generally hexagonal cleat support area 260. The free ends of the primary traction elements 262 extend beyond the free ends of the secondary traction elements 264 (in the cleat extension direction and/or when the shoe 200 is positioned on a flat surface) and are designed to engage the ground first. Note FIG. 2D. If the primary traction elements 262 sink a sufficient depth into the contact surface (e.g., a track, the ground, etc.), the secondary traction elements 264 then may engage the contact surface and provide additional traction to the wearer. In an individual cleat mount area 260 around a single primary traction element 262, the points or peaks of the immediately surrounding secondary traction elements 264 that surround that primary traction element 262 may be located within 1.5 inches (3.8 cm) (and in some examples, within 1 inch (2.5 cm) or even within 0.75 inch (1.9 cm)) of the peak or point of the surrounded primary traction element 262 in that mount area 260.

In at least some examples of this invention, the outer perimeter boundary rim 242O and the support structure 250 extending into/across the open space 244 may constitute an unitary, one-piece construction. The one-piece construction can be formed from a polymeric material, such as a PEBAX® brand polymer material or a thermoplastic polyurethane material. As another example, if desired, the ground-engaging component 240 may be made as multiple parts (e.g., split at the forward-most toe area, split along the front-to-back direction, and/or split or separated at other areas), wherein each part includes one or more of: at least a portion of the outer perimeter boundary rim 242O and at least a portion of the support structure 250. As another option, if desired, rather than an unitary, one-piece construction, one or more of the outer perimeter boundary rim 242O and the support structure 250 individually may be made of two or more parts.

Optionally, the outer perimeter boundary rim 242O and the support structure 250, whether made from one part or more, will have a combined mass of less than 60 grams (exclusive of any separate primary traction elements, like spikes 262, and/or primary traction element mounting hardware, like base components 262B), and in some examples, a combined mass of less than 50 grams, less than 45 grams, less than 40 grams, less than 35 grams, or even less than 30 grams. The entire ground-engaging component 240 also may have any of these weighting characteristics. The ground-engaging component 240, in its final form, may be relatively flexible and pliable, e.g., so as to flex and move naturally with a wearer's foot during ambulatory activities and running/jogging events.

Figure 4A:
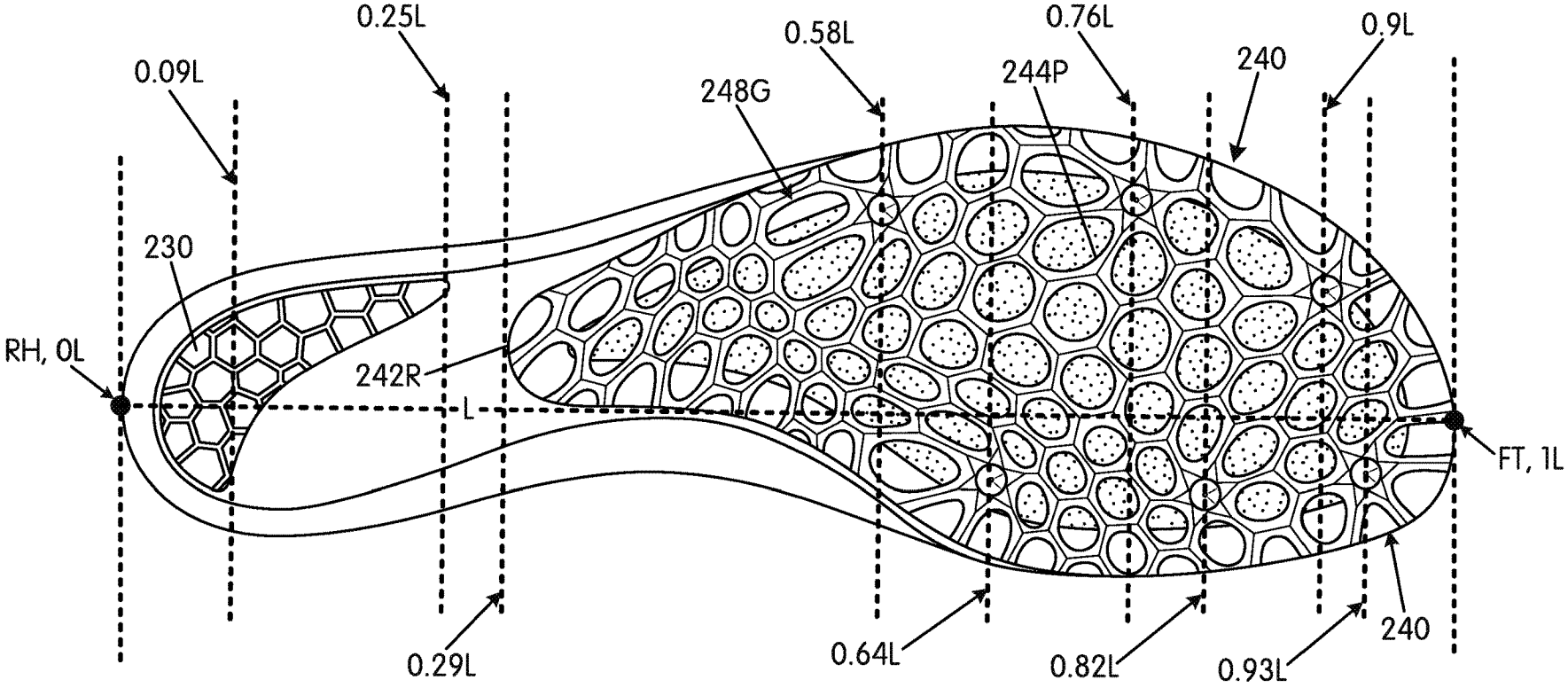
FIGS. 4A-4C are bottom views of sole structures and ground-engaging components in accordance with some examples of this invention that illustrate additional example features and aspects of the invention.

FIGS. 4A through 5H are provided to illustrate additional features that may be present in ground-engaging components 240 and/or articles of footwear 200 in accordance with at least some aspects of this invention. FIG. 4A is a view similar to that of FIG. 2B with the rear heel RH and forward toe FT locations of the sole structure 204 identified and the longitudinal length L and direction identified. Planes perpendicular to the longitudinal direction (and going into and out of the page in the transverse direction) are shown, and the locations of various footwear 200 and/or ground-engaging component 240 features are described with respect to these planes. For example, FIG. 4A illustrates that the heel reinforcement component 230 is structured and arranged so as to extend to a location of 0.25L in the lateral heel support area. In some examples of this invention, this forward-most extent of the heel reinforcement component 230 (at least at the lateral side) may be within a range of 0.15L to 0.35L, and in some examples, within a range of 0.2L to 0.3L. Also, as shown in FIG. 4A, this example heel reinforcement component 230 is structured and arranged so as to extend to a location of 0.09L in the medial heel support area. In some examples of this invention, this forward-most extent of the medial side of the heel reinforcement component 230 may be within a range of 0L to 0.2L, and in some examples, within a range of 0.04L to 0.16L. All of these perpendicular plane locations are based on the article of footwear 200's and/or the sole structure 204's longitudinal length L.

As another example, FIG. 4A illustrates that the rear-most extent 242R of the ground-engaging component 240 is located at 0.29L. In some examples of this invention, however, this rear-most extent 242R of the ground-engaging component 240 may be located within a range of 0.2L and 0.5L, and in some examples, within a range of 0.24 to 0.45L or even 0.25L to 0.5L (based on the article of footwear 200's and/or the sole structure 204's longitudinal length L).

Potential primary traction element attachment locations for three primary traction elements 262 on each side of the ground-engaging component 240 are described in the following table (with the "locations" being measured from a center location (or point) of the ground-contacting portion of the cleat/spike 262 and being based on the longitudinal length L of the article of footwear 200 and/or the sole structure 204):

| | General Range | More Specific Range | Illustrated Location |
|---|---|---|---|
| Rear Lateral Cleat | 0.45L to 0.75L | 0.5L to 0.7L | 0.58L |
| Middle Lateral Cleat | 0.6L to 0.85L | 0.68L to 0.8L | 0.76L |
| Forward Lateral Cleat | 0.8L to 0.96L | 0.84L to 0.94L | 0.9L |
| Rear Medial Cleat | 0.52L to 0.8L | 0.58L to 0.72L | 0.64L |
| Middle Medial Cleat | 0.65L to 0.92L | 0.75L to 0.88L | 0.82L |
| Forward Medial Cleat | 0.82L to 0.99L | 0.86L to 0.97L | 0.93L |

If desired, one or more additional primary traction elements 262 can be provided at other locations of the ground-engaging component 240 structure, including rearward of either or both of the identified rear cleats, between the identified lateral or medial cleats, forward of either or both of the forward cleats, and/or between the lateral and medial cleats (e.g., in the matrix structure 250 within the open area 244, at a central forward toe location, etc.). In the illustrated example, each lateral cleat is located further rearward in the longitudinal direction L than its corresponding medial cleat (i.e., the rearmost lateral cleat is further rearward than the rearmost medial cleat, the middle lateral cleat is further rearward than the middle medial cleat, and/or the forward-most lateral cleat is further rearward than the forwardmost medial cleat).

FIG. 4A further illustrates that the forward-most extent of the outer perimeter boundary rim 242O of the ground-engaging component 240 is located at 1.0L (at the forward-most toe location FT). This forward-most extent of the outer perimeter boundary rim 242O, however, may be located at other places, if desired, such as within a range of 0.90L and 1.0L, and in some examples, within a range of 0.92L to 1.0L (based on the longitudinal length L of the article of footwear and/or the sole structure 204).

Figure 4B:
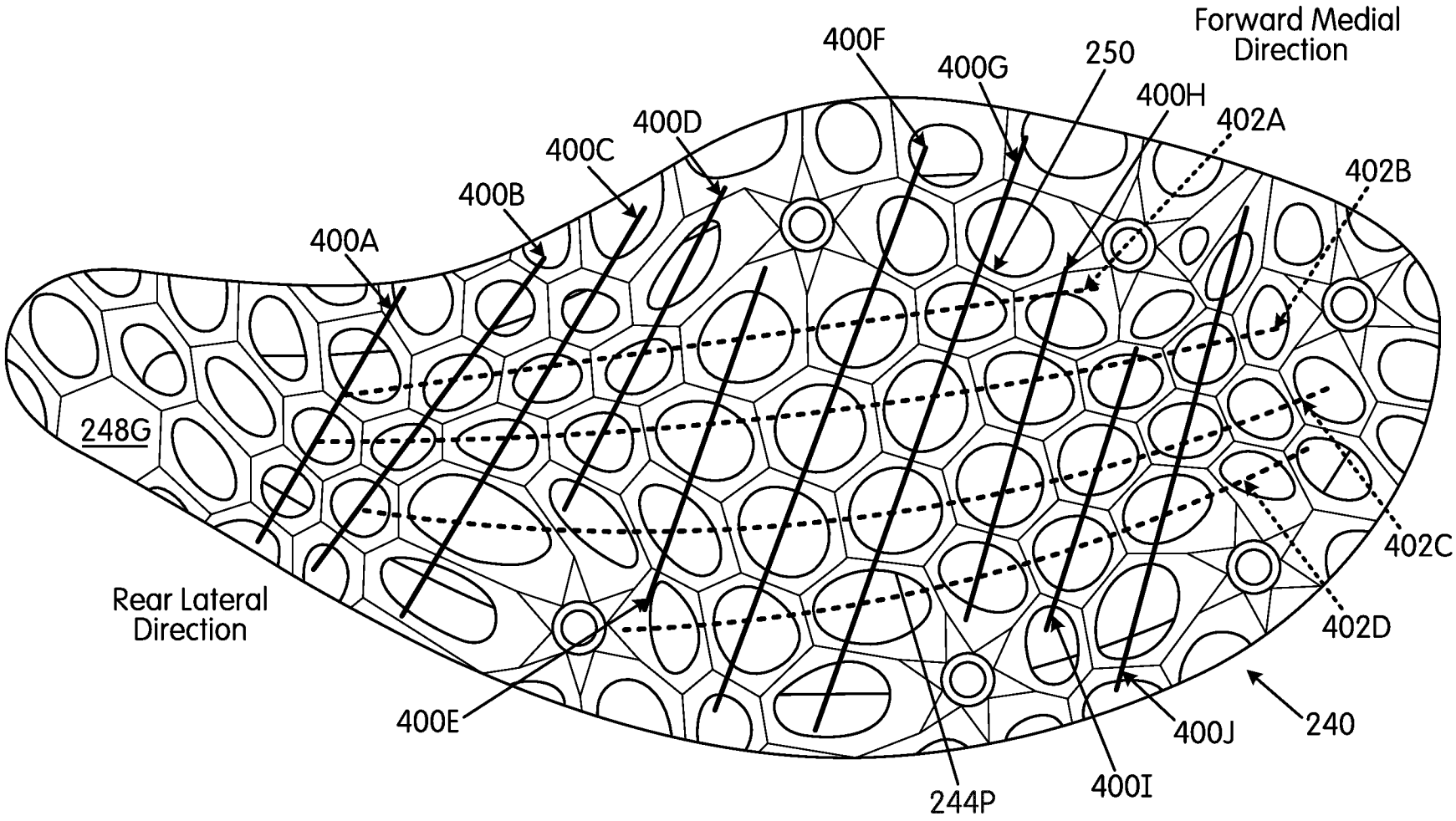
Figure 4C:
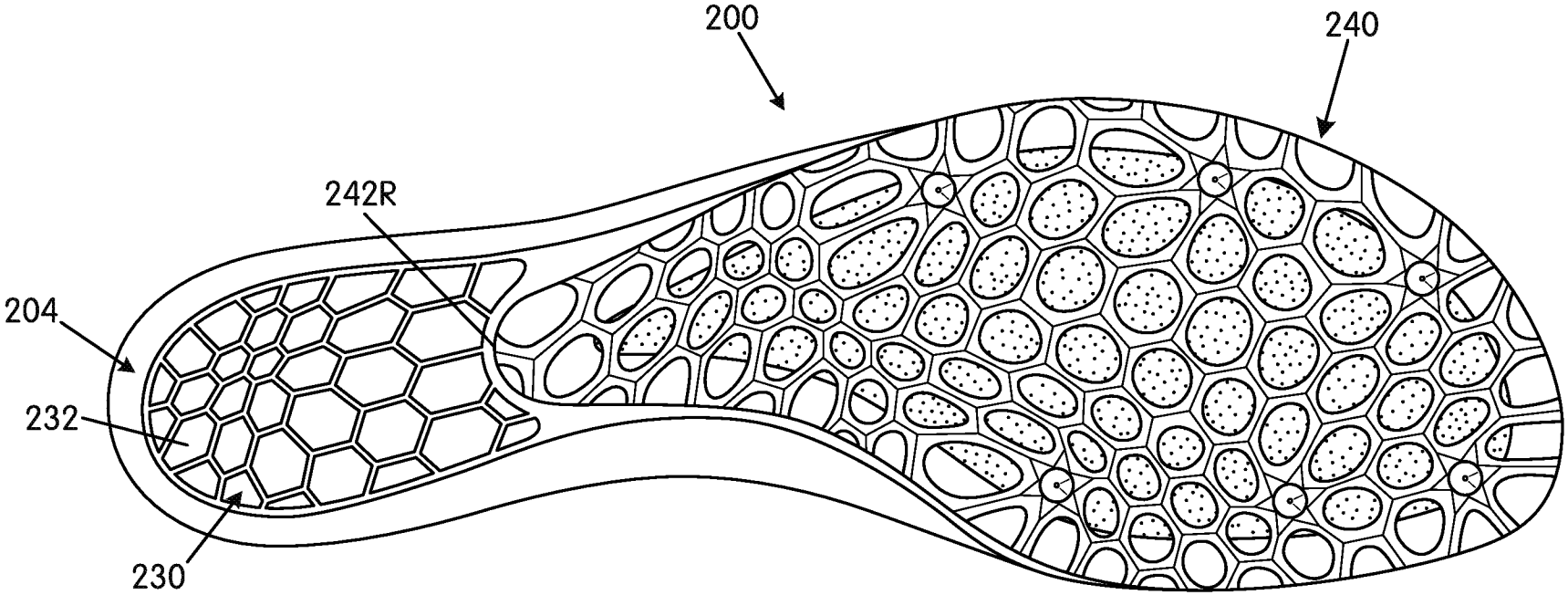

FIGS. 4A and 4B further illustrate that in these example structures 240, some cells of the matrix structures 250 are generally formed in lines or along curves that extend across the ground-engaging component 240 and the sole structure 204. The term "cells" used in this context is used generically to refer to any one or more of open cells 252, partially open cells 254, and/or closed cells (e.g., cells completely formed by the matrix structure 250 and closed off within the outer perimeter boundary rim 242O) in any numbers or combinations. In some example structures 240 in accordance with this aspect of the invention, from 4 to 20 "lines" or "curves" of adjacent cells may be formed in the ground-engaging element structure 240 (and in some examples, from 6-18 lines or curves of adjacent cells or even from 8-16 lines or curves of this type). Each "line" or "curve" of adjacent cells extending in the medial-to-lateral side direction may contain from 2 to 16 cells, and in some examples, from 2 to 12 cells or from 2-10 cells. A cell is "adjacent" to another cell if a straight line can be drawn to connect openings of the two cells without that straight line crossing through the open space of another cell or passing between two other adjacent cells and/or if the two cells share a wall or side. "Adjacent cells" also may be located close to one another (e.g., so that a straight line distance between the openings of the cells is less than 1 inch long (and in some examples, less than 0.5 inches long).

More specifically, and referring to FIG. 4B (which is a view similar to FIG. 3B), the ground-facing surface 248G of the ground-engaging component 240 is shown with additional lines to highlight certain cell features that may be present in at least some example structures according to the invention. For example, this illustrated matrix structure 250 defines several sets of at least partially open cells (meaning open cells 252 and/or partially open cells 254), wherein geographical centers of at least three cells of these sets of at least partially open cells are substantially aligned or highly substantially aligned. Examples of the "sets" of aligned cells are shown in FIG. 4B at alignment lines 400A-400J. Notably, while not a requirement for any or all "sets" of three or more aligned cells, the "alignment lines" 400A-400J shown in this illustrated example extend from a rear lateral direction toward a forward medial direction of the ground-engaging component 240 and/or the sole structure 204 (and not necessarily in the direct transverse direction). If desired, any one or more sets of cells may be aligned along a line that extends from a rear lateral direction toward a forward medial direction of the ground-engaging component 240 and/or sole structure 204. These sets of "substantially aligned" or "highly substantially aligned" cells can help provide more natural flexion and motion for the foot as the person's weight rolls forward in a direction from the heel to the toe and/or from the midfoot to the toe during a step cycle. For example, the substantially aligned or highly substantially aligned open spaces 244 along lines 400A-440J provide and help define lines of flex that extend across the foot from the lateral side to the medial side direction and help the ground-engaging component 240 bend with the foot as the wearer rolls the foot forward for the toe-off phase of a step cycle.

FIG. 4B further shows sets of cells located along one or more curves 402A-402D that extend in the generally forward-to-rear direction of the ground-engaging component 240. One or more of the curves 402A-402D are oriented so that their concave surface faces the medial side of the ground-engaging component 240 and/or sole structure 204 and so that their convex surface faces the lateral side of the ground-engaging component 240 and/or sole structure 204. The curves 402A-402D are generally gently and smoothly curved. While four curved sets of at least partially open cells are shown in FIG. 4B, more or fewer sets could be provided, if desired. As a more specific example, from one to six curved sets of cells could be provided across the ground-engaging component 240 and/or sole structure 204, and each of these curved sets of cells 402A-402D may include from 4-18 cells, and in some examples, from 6-15 cells, or from 8-12 cells. These "curved" sets of cells also can help provide more natural flexion and motion for the foot as the person's weight rolls forward from the heel and/or midfoot to the toe and from the lateral side to the medial side during a step cycle. For example, adjacent open spaces 244 along curves 402A-402D provide and help define curved lines of flex that extend across the foot from the rear to front direction and help the ground-engaging component 240 bend along a front-to-back curved line with the foot as the wearer rolls the foot from the lateral side to the medial side for the toe-off phase of a step cycle.

FIGS. 4A and 4B further illustrate that the open space 244 defined through at least some of the open cells 252 may have an area around perimeter 244P (e.g., the ovoid area) of at least 60 $mm^2$, and in some examples, at least 70 $mm^2$ or even at least 80 $mm^2$. Some of the open cells 252 may have areas (e.g., cell opening areas around perimeter 244P) within a range of 60 $mm^2$ to 175 $mm^2$, 70 $mm^2$ to 160 $mm^2$, or even within a range of 80 $mm^2$ to 150 $mm^2$. This perimeter 244P is shown in FIGS. 4A, 4B, and 5A. Also, if desired, in some examples of this invention, at least 3 adjacent substantially aligned open cells 252 (e.g., along lines 400A-400J), highly substantially aligned open cells 252 (e.g., along lines 400A-400J), and/or curve oriented open cells 252 (e.g., on curves 402A-402D) will have open cell areas (around perimeter 244P) within the sizes and/or size ranges described above. As some additional examples, at least 40% (and in some examples, at least 50%, or even at least 60%) of the open cells 252 of the ground-engaging component 240 may have areas around their perimeter 244P within any of the noted size ranges.

Figure 5B:
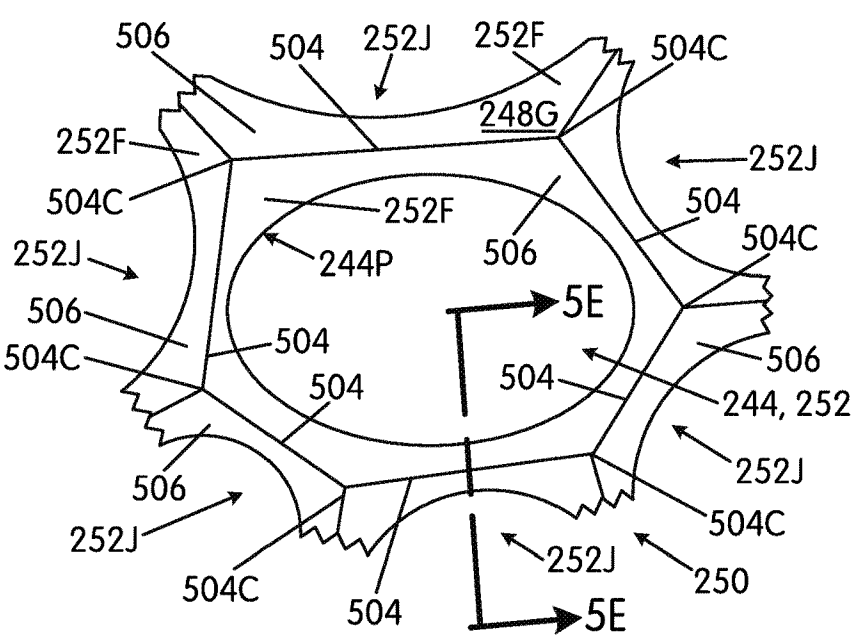
FIGS. 5A through 5H provide various views to illustrate additional features of the ground-engaging component's support structure in accordance with some example features of this invention.
Figure 5A:
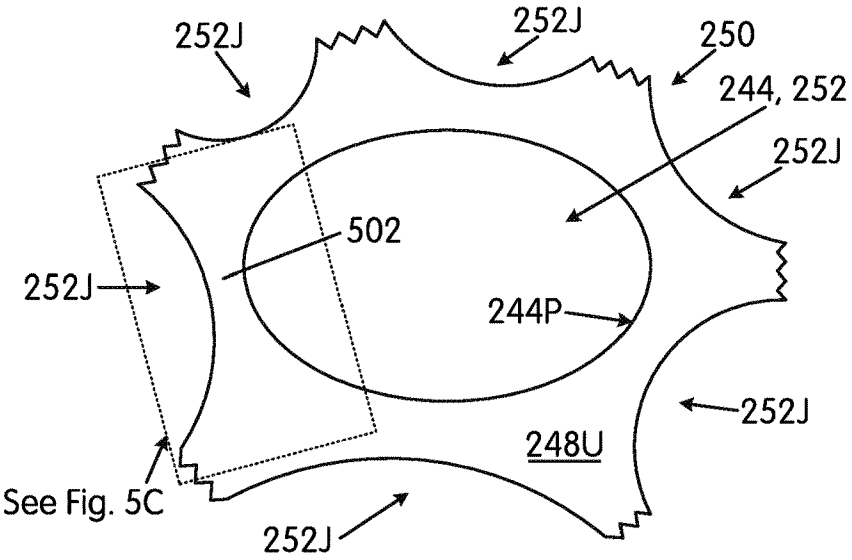
Figure 5E:
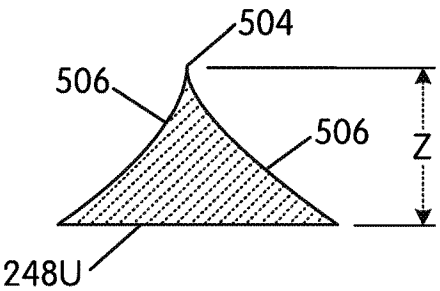
Figure 5D:
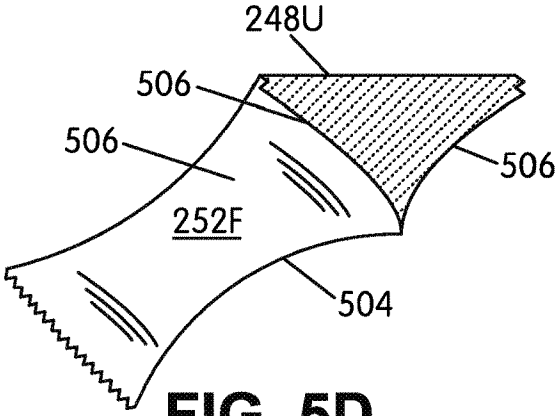
Figure 5C:
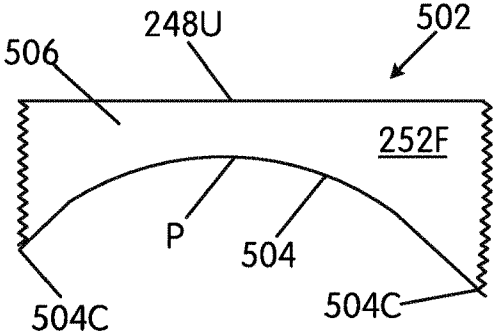

FIGS. 5A through 5H are provided to help illustrate potential features of the matrix structure 250 and the various cells described above. FIG. 5A provides an enlarged top view showing the upper-facing surface 248U at an area around an open cell 252 defined by the matrix structure 250 (the open space is shown at 244). FIG. 5B shows an enlarged bottom view of this same area of the matrix structure 250 (showing the ground-facing surface 248G). FIG. 5C shows a side view at one leg 502 of the matrix structure 250, and FIG. 5D shows a cross-sectional and partial perspective view of this same leg 502 area. As shown in these figures, the matrix structure 250 provides a smooth top (upper-facing) surface 248U but a more angular ground-facing surface 248G. More specifically, at the ground-facing surface 248G, the matrix structure 250 defines a generally hexagonal ridge 504 around the open cell 252, with the corners 504C of the hexagonal ridge 504 located at a junction area between three adjacent cells in a generally triangular arrangement (the junction of the open cell 252 and two adjacent cells 252J, which may be open, partially open, and/or closed cells, in this illustrated example). Some cells (open, partially open, or closed) will have six other cells adjacent and arranged around them (e.g., in the generally triangular arrangement of adjacent cells, as mentioned above).

As further shown in these figures, along with FIG. 5E (which shows a sectional view along line 5E-5E of FIG. 5B), the side walls 506 between the upper-facing surface 248U at cell perimeter 244P and the ground-facing surface 248G, which ends at ridge 504 in this example, are sloped. Thus, the overall matrix structure 250, at least at some locations between the generally hexagonal ridge 504 corners 504C, may have a triangular or generally triangular shaped cross section (e.g., see FIGS. 5D and 5E). Moreover, as shown in FIGS. 5C and 5D, the generally hexagonal ridge 504 may be sloped or curved from one corner 504C to the adjacent corners 504C (e.g., with a local maxima point P located between adjacent corners 504C). The side walls 506 may have a planar surface (e.g., like shown in FIG. 5H), a partially planar surface (e.g., planar along some of its height dimension Z), a curved surface (e.g., a concave surface as shown in FIG. 5E), or a partially curved surface (e.g., curved along some of its height dimension Z).

The raised corners 504C of the generally hexagonal ridge 504 in this illustrated example ground-engaging component 240 may be formed as sharp peaks that may act as secondary traction elements at desired locations around the ground-engaging component 240. As evident from these figures and the discussion above, the generally hexagonal ridges 504 and side walls 506 from three adjacent cells (e.g., 252 and two 252J cells) meet at a single (optionally raised) corner 504C and thus may form a substantially pyramid type structure (e.g., a pyramid having three side walls 252F, 506 that meet at a point 504C). This substantially pyramid type structure can have a sharp point (e.g., depending on the slopes of walls 252F, 506), which can function as a secondary traction element when it contacts the ground in use. This same type of pyramid structure formed by matrix 250 also may be used to form the secondary traction elements 264 at cleat support areas 260.

Not every cell (open, partially open, or closed) in the ground-engaging component 240 needs to have this type of secondary traction element structure (e.g., with raised pointed pyramids at the generally hexagonal ridge 504 corners 504C), and in fact, not every generally hexagonal ridge 504 corner 504C around a single cell 252 needs to have a raised secondary traction element structure. One or more of the ridge components 504 of a given cell 252 may have a generally straight line structure along the ground-facing surface 248G and/or optionally a linear or curved structure that moves closer to the upper-facing surface 248U moving from one corner 504C to an adjacent corner 504C. In this manner, secondary traction elements may be placed at desired locations around the ground-engaging element 240 structure and left out (e.g., with smooth corners 504C and/or edges in the z-direction) at other desired locations. Additionally or alternatively, if desired, raised points and/or other secondary traction elements could be provided at other locations on the matrix structure 250, e.g., anywhere along ridge 504 or between adjacent cells.

Notably, in this example construction, the matrix structure 250 defines at least some of the cells 252 (and 252J) such that the perimeter of the entrance to the cell opening 252 around the upper-facing surface 248U (e.g., defined by perimeter 244P of the ovoid shaped opening) is smaller than the perimeter of the entrance to the cell opening 252 around the ground-facing surface 248G (e.g., defined by the generally hexagonal perimeter ridge 504). Stated another way, the area of the entrance to the cell opening 252 from the upper-facing surface 248U (e.g., the area within the perimeter 244P of the ovoid shaped opening) is smaller than the area of the entrance to the cell opening 252 from the ground-facing surface 248G (e.g., the area within the generally hexagonal perimeter ridge 504). The generally hexagonal perimeter ridge 504 completely surrounds the perimeter 244P in at least some cells. This difference in the entrance areas and sizes is due to the sloped/curved sides walls 506 from the upper-facing surface 248U to the ground-facing surface 248G.

Figure 5G:
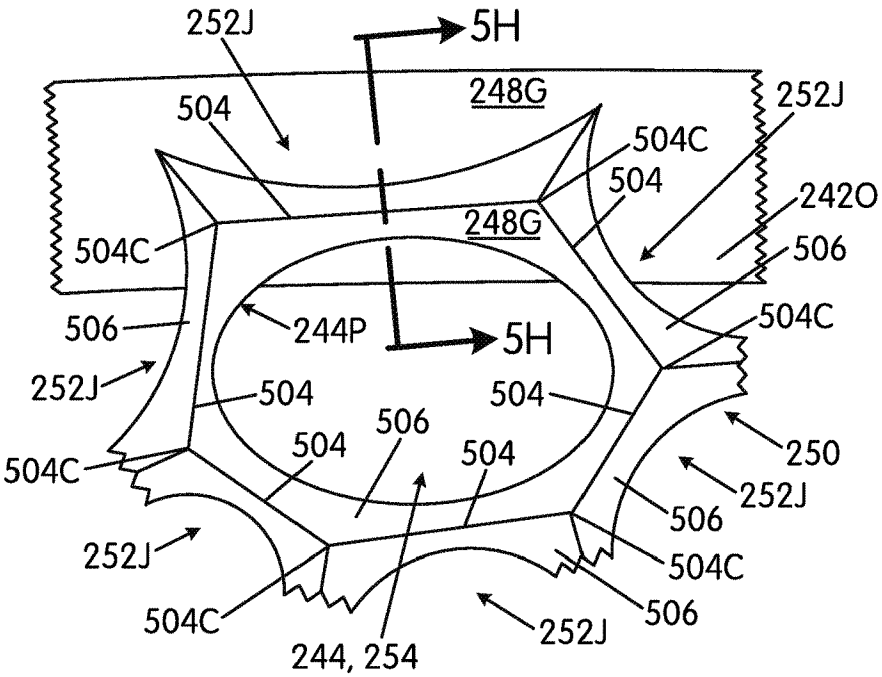
Figure 5F:
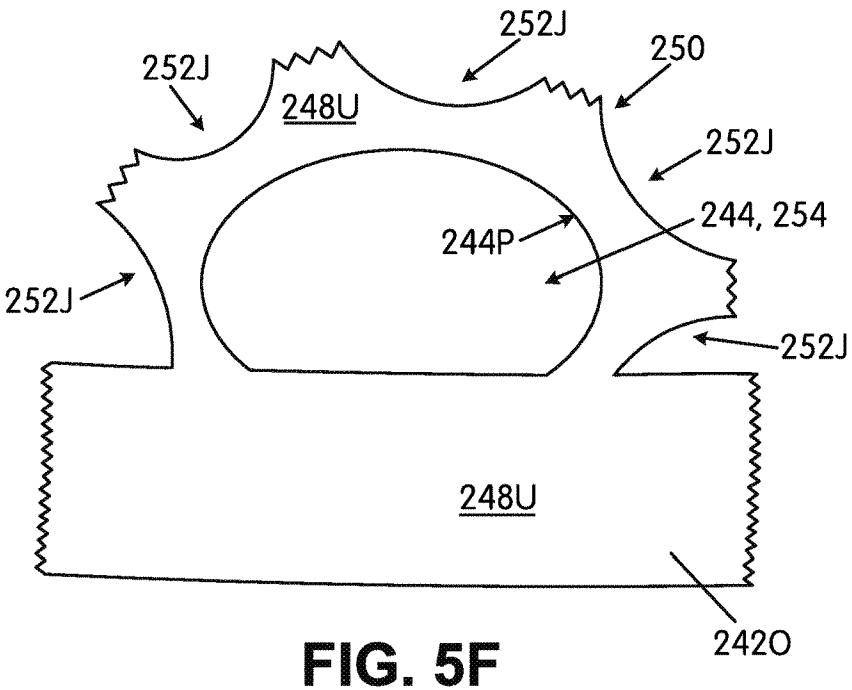
Figure 5H:
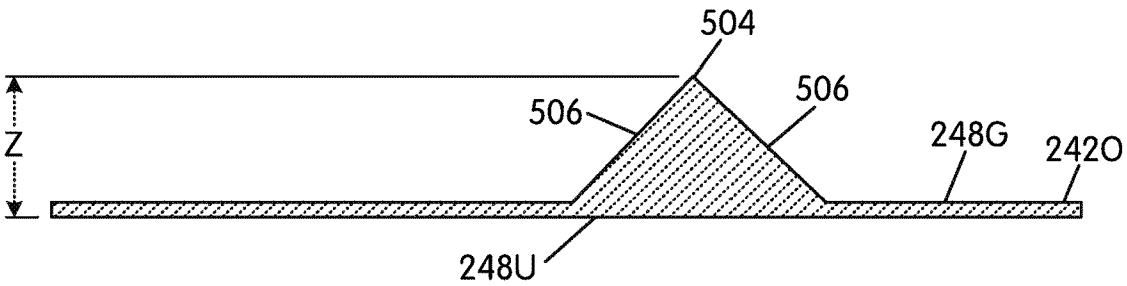

FIGS. 5F through 5H show views similar to those in FIGS. 5A, 5B, and 5E but with a portion of the matrix structure 250 originating in the outer perimeter boundary rim 242O (and thus the cell is a partially open cell 254). As shown in FIG. 5G, in this illustrated example, the matrix structure 250 morphs outward and downward from the ground-facing surface 248G of the outer perimeter boundary rim 242O. This may be accomplished, for example, by molding the matrix structure 250 as an unitary, one-piece component with the outer perimeter boundary rim member 242O. Alternatively, the matrix structure 250 could be formed as a separate component that is fixed to the outer perimeter boundary rim member 242O, e.g., by cements or adhesives, by mechanical connectors, etc. As another option, the matrix structure 250 may be made as an unitary, one-piece component with the outer perimeter boundary rim member 242O by rapid manufacturing techniques, including rapid manufacturing additive fabrication techniques (e.g., 3D printing, laser sintering, etc.) or rapid manufacturing subtractive fabrication techniques (e.g., laser ablation, etc.). The structures and various parts shown in FIGS. 5F-5H may have any one or more of the various characteristics, options, and/or features of the similar structures and parts shown in FIGS. 5A-5E (and like reference numbers in these figures represent the same or similar parts to those used in other figures).

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes the subject-matter described in the following numbered paragraphs (referred to as "para." or "paras."):

[Para. 1]. A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component, and wherein a rearmost extent of the outer perimeter boundary rim is located within one of: an arch support area or a forward heel support area of the ground-engaging component; and a support structure extending from the outer perimeter boundary rim and at least partially across the open space.

[Para. 2] The ground-engaging component according to Para. 1, wherein the support structure includes a matrix structure extending at least partially across the open space at least at the forefoot support area to define an open cellular construction with plural open cells within the open space at least at the forefoot support area.

[Para. 3] The ground-engaging component according to Para. 2, wherein at least 60% of the open cells of the open cellular construction have curved perimeters with no distinct corners.

[Para. 4] The ground-engaging component according to Para. 2 or Para. 3, wherein the matrix structure further defines a first cleat support area between a lateral side of the outer perimeter boundary rim and a medial side of the outer perimeter boundary rim.

[Para. 5] The ground-engaging component according to Para. 2 or Para. 3, wherein the matrix structure further defines a first cleat support area at or at least partially within the ground-facing surface of the outer perimeter boundary rim.

[Para. 6] The ground-engaging component according to Para. 4 or Para. 5, further comprising:

a track spike engaged at the first cleat support area.

[Para. 7] The ground-engaging component according to any one of Paras. 4-6, wherein the matrix structure further defines a plurality of secondary traction elements dispersed around the first cleat support area.

[Para. 8] The ground-engaging component according to Para. 2 or Para. 3, wherein the matrix structure further defines:

a first cleat support area at or at least partially in a lateral side of the ground-facing surface of the outer perimeter boundary rim;

a second cleat support area at or at least partially in the lateral side of the ground-facing surface of the outer perimeter boundary rim and located forward of the first cleat support area;

a third cleat support area at or at least partially in a medial side of the ground-facing surface of the outer perimeter boundary rim; and a fourth cleat support area at or at least partially in the medial side of the ground-facing surface of the outer perimeter boundary rim and located forward of the third cleat support area.

[Para. 9] The ground-engaging component according to Para. 8, further comprising a first track spike engaged at the first cleat support area, a second track spike engaged at the second cleat support area, a third track spike engaged at the third cleat support area, and a fourth track spike engaged at the fourth cleat support area.

[Para. 10] The ground-engaging component according to Para. 8, wherein the matrix structure further defines:

a fifth cleat support area at or at least partially in the lateral side of the ground-facing surface of the outer perimeter boundary rim and located forward of the second cleat support area; and a sixth cleat support area at or at least partially in the medial side of the ground-facing surface of the outer perimeter boundary rim and located forward of the fourth cleat support area.

[Para. 11] The ground-engaging component according to Para. 10, further comprising a first track spike engaged at the first cleat support area, a second track spike engaged at the second cleat support area, a third track spike engaged at the third cleat support area, a fourth track spike engaged at the fourth cleat support area, a fifth track spike engaged at the fifth cleat support area, and a sixth track spike engaged at the sixth cleat support area.

[Para. 12] The ground-engaging component according to any one of Paras. 2 through 11, wherein the matrix structure further defines a first set of open cells, wherein geographical centers of openings of at least three cells of the first set of open cells are substantially aligned along a line that extends from a rear lateral direction toward a forward medial direction of the ground-engaging component.

[Para. 13] The ground-engaging component according to Para. 12, wherein the matrix structure further defines a second set of open cells located forward of the first set of open cells, wherein geographical centers of openings of at least three cells of the second set of open cells are substantially aligned along a line that extends from the rear lateral direction toward the forward medial direction of the ground-engaging component.

[Para. 14] The ground-engaging component according to Para. 13, wherein the matrix structure further defines a third set of open cells located forward of the second set of open cells, wherein geographical centers of openings of at least three cells of the third set of open cells are substantially aligned along a line that extends from the rear lateral direction toward the forward medial direction of the ground-engaging component.

[Para. 15] The ground-engaging component according to Para. 14, wherein the matrix structure further defines a fourth set of open cells located forward of the third set of open cells, wherein geographical centers of openings of at least three cells of the fourth set of open cells are substantially aligned along a line that extends from the rear lateral direction toward the forward medial direction of the ground-engaging component.

[Para. 16] The ground-engaging component according to Para. 15, wherein the matrix structure further defines a fifth set of open cells located forward of the fourth set of open cells, wherein geographical centers of openings of at least three cells of the fifth set of open cells are substantially aligned along a line that extends from the rear lateral direction toward the forward medial direction of the ground-engaging component.

[Para. 17] The ground-engaging component according to Para. 16, wherein the matrix structure further defines a sixth set of open cells located forward of the fifth set of open cells, wherein geographical centers of openings of at least three cells of the sixth set of open cells are substantially aligned along a line that extends from the rear lateral direction toward the forward medial direction of the ground-engaging component.

[Para. 18] The ground-engaging component according to Para. 17, wherein the matrix structure further defines a seventh set of open cells located forward of the sixth set of open cells, wherein geographical centers of openings of at least three cells of the seventh set of open cells are substantially aligned along a line that extends from the rear lateral direction toward the forward medial direction of the ground-engaging component.

[Para. 19] The ground-engaging component according to Para. 18, wherein the matrix structure further defines an eighth set of open cells located forward of the seventh set of open cells, wherein geographical centers of openings of at least three cells of the eighth set of open cells are substantially aligned along a line that extends from the rear lateral direction toward the forward medial direction of the ground-engaging component.

[Para. 20] The ground-engaging component according to Para. 19, wherein the matrix structure further defines a ninth set of open cells located forward of the eighth set of open cells, wherein geographical centers of openings of at least three cells of the ninth set of open cells are substantially aligned along a line that extends from the rear lateral direction toward the forward medial direction of the ground-engaging component.

[Para. 21] The ground-engaging component according to Para. 20, wherein the matrix structure further defines a tenth set of open cells located forward of the ninth set of open cells, wherein geographical centers of openings of at least three cells of the tenth set of open cells are substantially aligned along a line that extends from the rear lateral direction toward the forward medial direction of the ground-engaging component.

[Para. 22] The ground-engaging component according to any preceding Para., wherein the outer perimeter boundary rim at least 3 mm wide.

[Para. 23] The ground-engaging component according to any preceding Para., wherein the outer perimeter boundary rim is present around at least 90% of the outer perimeter of the ground-engaging component.

[Para. 24] An article of footwear, comprising:

an upper; and a sole structure engaged with the upper, the sole structure including a ground-engaging component according to any preceding Para.

[Para. 25] The article of footwear according to Para. 24, wherein at least a portion of the upper includes a woven textile component.

[Para. 26] The article of footwear according to Para. 24, wherein at least a portion of the upper includes a knitted textile component.

[Para. 27] The article of footwear according to any one of Paras. 24 through 26, wherein the sole structure further includes a midsole component between the ground-engaging component and a bottom of the upper.

[Para. 28] The article of footwear according to Para. 27, wherein the midsole component includes a foam midsole element.

[Para. 29] The article of footwear according to Para. 27 or Para. 28, wherein a bottom surface of the midsole component is exposed at an exterior of the sole structure.

[Para. 30] The article of footwear according to Para. 29, wherein the bottom surface of the midsole component extends at least from the rearmost extent of the outer perimeter boundary rim of the ground-engaging component to a rear heel support area of the sole structure.

[Para. 31] The article of footwear according to any one of Paras. 24 through 30, wherein the sole structure further includes a heel reinforcement component located at least at a lateral, rear heel support area of the sole structure.

[Para. 32] The article of footwear according to any one of Paras. 24 through 30, wherein the sole structure further includes a heel reinforcement component located at least at a lateral heel support area and a rear heel support area of the sole structure.

[Para. 33] The article of footwear according to Para. 31 or Para. 32, wherein the heel reinforcement component includes a matrix structure with a plurality of open cells.

[Para. 34] The article of footwear according to any one of Paras. 24 through 30, wherein the outer perimeter boundary rim of the ground-engaging component tapers inward at an arch support area of the sole structure, and wherein the midsole component forms an outer lateral edge and an outer medial edge of the sole structure within at least some of the arch support area of the sole structure.

[Para. 35] The article of footwear according to any one of Paras. 24 through 30, wherein the outer perimeter boundary rim of the ground-engaging component forms an outer lateral edge and an outer medial edge of the sole structure in a forefoot support area of the sole structure, and wherein the midsole component forms the outer lateral edge and the outer medial edge of the sole structure through at least some of an arch support area of the sole structure.

What is claimed is:

1. A ground-engaging component for an article of footwear, comprising:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component, and wherein a rearmost extent of the outer perimeter boundary rim is located within one of: an arch support area or a forward heel support area of the ground-engaging component; and a support structure extending from the outer perimeter boundary rim and at least partially across the open space; wherein the support structure includes a matrix structure extending at least partially across the open space at least at the forefoot support area to define an open cellular construction with plural open cells within the open space at least at the forefoot support area;

wherein the matrix structure further defines a first set of open cells, wherein geographical centers of openings of at least three cells of the first set of open cells are substantially aligned along a line that extends from a rear lateral direction toward a forward medial direction of the ground-engaging component, and wherein the matrix structure further defines a second set of open cells located forward of the first set of open cells, wherein geographical centers of openings of at least three cells of the second set of open cells are substantially aligned along a line that extends from the rear lateral direction toward the forward medial direction of the ground-engaging component;

wherein the matrix structure further defines a first curved set of cells aligned along a first curve extending in a forward-to-rear direction of the ground-engaging component wherein the first curve is oriented so that a concave surface faces the medial side of the ground-engaging component and a convex surface faces the lateral side of the ground-engaging component, wherein the first curved set of cells includes from 4-18 at least partially open cells.

2. The ground-engaging component according to claim 1, wherein the matrix structure further defines a first cleat support area between a lateral side of the outer perimeter boundary rim and a medial side of the outer perimeter boundary rim.

3. The ground-engaging component according to claim 2, wherein the matrix structure further defines a plurality of secondary traction elements dispersed around the first cleat support area.

4. The ground-engaging component according to claim 1, wherein the matrix structure further defines a first cleat support area at or at least partially within the ground-facing surface of the outer perimeter boundary rim.

5. The ground-engaging component according to claim 1, wherein the matrix structure further defines:

a first cleat support area at or at least partially in a lateral side of the ground-facing surface of the outer perimeter boundary rim;

a second cleat support area at or at least partially in the lateral side of the ground-facing surface of the outer perimeter boundary rim and located forward of the first cleat support area;

a third cleat support area at or at least partially in a medial side of the ground-facing surface of the outer perimeter boundary rim; and a fourth cleat support area at or at least partially in the medial side of the ground-facing surface of the outer perimeter boundary rim and located forward of the third cleat support area.

6. The ground-engaging component according to claim 5, wherein the matrix structure further defines:

a fifth cleat support area at or at least partially in the lateral side of the ground-facing surface of the outer perimeter boundary rim and located forward of the second cleat support area; and a sixth cleat support area at or at least partially in the medial side of the ground-facing surface of the outer perimeter boundary rim and located forward of the fourth cleat support area.

7. The ground-engaging component according to claim 1, wherein the matrix structure further defines a third set of open cells located forward of the second set of open cells, wherein geographical centers of openings of at least three cells of the third set of open cells are substantially aligned along a line that extends from the rear lateral direction toward the forward medial direction of the ground-engaging component, and wherein the matrix structure further defines a fourth set of open cells located forward of the third set of open cells, wherein geographical centers of openings of at least three cells of the fourth set of open cells are substantially aligned along a line that extends from the rear lateral direction toward the forward medial direction of the ground-engaging component.

8. The ground-engaging component according to claim 1, wherein the outer perimeter boundary rim is present around at least 90% of the outer perimeter of the ground-engaging component.

9. The ground-engaging component according to claim 1, wherein at least 60% of the open cells of the open cellular construction have curved perimeters with no distinct corners.

10. An article of footwear, comprising:

an upper; and a sole structure engaged with the upper, the sole structure including a ground-engaging component that includes:

an outer perimeter boundary rim that at least partially defines an outer perimeter of the ground-engaging component, wherein the outer perimeter boundary rim defines an upper-facing surface and a ground-facing surface opposite the upper-facing surface, wherein the outer perimeter boundary rim defines an open space at least at a forefoot support area of the ground-engaging component, and wherein a rearmost extent of the outer perimeter boundary rim is located within one of: an arch support area or a forward heel support area of the ground-engaging component; and a support structure extending from the outer perimeter boundary rim and at least partially across the open space; wherein the support structure includes a matrix structure extending at least partially across the open space at least at the forefoot support area to define an open cellular construction with plural open cells within the open space at least at the forefoot support area;

wherein the matrix structure further defines a first set of open cells, wherein geographical centers of openings of at least three cells of the first set of open cells are substantially aligned along a line that extends from a rear lateral direction toward a forward medial direction of the ground-engaging component, and wherein the matrix structure further defines a second set of open cells located forward of the first set of open cells, wherein geographical centers of openings of at least three cells of the second set of open cells are substantially aligned along a line that extends from the rear lateral direction toward the forward medial direction of the ground-engaging component;

wherein the matrix structure further defines a first curved set of cells aligned along a first curve extending in a forward-to-rear direction of the ground-engaging component wherein the first curve is oriented so that a concave surface faces the medial side of the ground-engaging component and a convex surface faces the lateral side of the ground-engaging component, wherein the first curved set of cells includes from 4-18 at least partially open cells wherein the outer perimeter boundary rim of the ground-engaging component forms an outer lateral edge and an outer medial edge of the sole structure in a forefoot support area of the sole structure, and wherein the sole structure further includes a midsole component between the ground-engaging component and a bottom of the upper, wherein the midsole component forms the outer lateral edge and the outer medial edge of the sole structure through at least some of an arch support area of the sole structure.

11. The article of footwear according to claim 10, wherein at least a portion of the upper includes a knitted textile component or a woven textile component.

12. The article of footwear according to claim 10, wherein a bottom surface of the midsole component is exposed at an exterior of the sole structure.

13. The article of footwear according to claim 12, wherein the bottom surface of the midsole component extends at least from the rearmost extent of the outer perimeter boundary rim of the ground-engaging component to a rear heel support area of the sole structure.

14. The article of footwear according to claim 10, wherein the sole structure further includes a heel reinforcement component located at least at a lateral, rear heel support area of the sole structure.

15. The article of footwear according to claim 14, wherein the heel reinforcement component includes a matrix structure with a plurality of open cells.

16. The article of footwear according to claim 10, wherein the outer perimeter boundary rim of the ground-engaging component tapers inward at an arch support area of the sole structure, and wherein the midsole component forms an outer lateral edge and an outer medial edge of the sole structure within at least some of the arch support area of the sole structure.

17. The article of footwear according to claim 10, wherein at least 60% of the open cells of the open cellular construction have curved perimeters with no distinct corners.

* * * * *